US006237467B1

(12) United States Patent
Beck

(10) Patent No.: US 6,237,467 B1
(45) Date of Patent: May 29, 2001

(54) HYDROSTATIC MACHINE PISTON

(75) Inventor: Josef Beck, Haigerloch (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 0 days.

(21) Appl. No.: 09/331,918

(22) PCT Filed: Feb. 2, 1998

(86) PCT No.: PCT/EP98/00551

§ 371 Date: Jun. 29, 1999

§ 102(e) Date: Jun. 29, 1999

(87) PCT Pub. No.: WO98/36156

PCT Pub. Date: Aug. 20, 1998

(30) Foreign Application Priority Data

Feb. 17, 1997 (DE) ..... 197 06 075

(51) Int. Cl.[7] ..... F01B 31/10
(52) U.S. Cl. ..... 92/157
(58) Field of Search ..... 92/71, 157

(56) References Cited

U.S. PATENT DOCUMENTS

| | | | |
|---|---|---|---|
| 3,068,563 | 12/1962 | Reverman . | |
| 3,319,575 | 5/1967 | Havens . | |
| 5,076,148 * | 12/1991 | Adler | 92/158 |
| 5,265,331 | 11/1993 | Engel et al. | 29/888.044 |

FOREIGN PATENT DOCUMENTS

| | | |
|---|---|---|
| 1 593 775 | 6/1970 | (DE) . |
| 23 64 725 | 7/1975 | (DE) . |
| 26 53 867 | 6/1978 | (DE) . |
| 3204264 A1 | 8/1983 | (DE) . |
| 3406782 C2 | 8/1984 | (DE) . |
| 3609892 A1 | 10/1986 | (DE) . |
| 3602651 A1 | 7/1987 | (DE) . |
| 3804424 C1 | 2/1988 | (DE) . |
| 3732648 C2 | 4/1989 | (DE) . |
| 3919329 | 12/1990 | (DE) . |

* cited by examiner

*Primary Examiner*—Edward K. Look
*Assistant Examiner*—Thomas E. Lazo
(74) *Attorney, Agent, or Firm*—Scully, Scott, Murphy & Presser

(57) ABSTRACT

The invention relates to a piston for a hydrostatic machine and a corresponding production method. In a conventional production method of this type, the piston is shaped from a blank into a shank section and a ball and socket joint section connected to the shank section by means of a neck section. According to the inventive embodiment, an additional blank for an inner tube is inserted into the blank of the outer tube before the latter is shaped. A hollow piston comprising one or more hollow chambers between the inner and outer tubes is formed after both blanks have been shaped.

20 Claims, 2 Drawing Sheets

HYDROSTATIC MACHINE PISTON

Figure 1A:
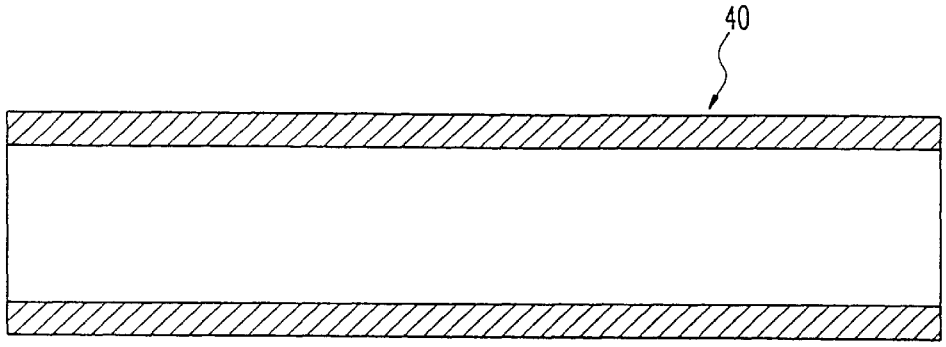

The invention relates to a piston for a hydrostatic machine, in particular an axial piston machine, and to a process for producing a piston of this kind.

The solid pistons usually used in axial piston machines set limits to operations at relatively high rotational speeds. High rotational speeds give rise to problems of strength for the cylinders on account of the high centrifugal forces and for the piston retaining device on account of the high inertial forces, as well as thermal problems at the contact surfaces between pistons and cylinders on account of the frictional forces resulting from the centrifugal forces. Hollow pistons are therefore used to operate axial piston machines with a high rotational speed.

Hollow pistons are already known in various designs and are generally produced by means of a machining manufacturing process. Constructions with a cavity which is open towards the working cylinder have the disadvantage of the cavity being filled with pressure fluid with each piston stroke. This region of the volume is consequently compressed and expanded again with each piston stroke, the result of which is a deterioration in efficiency. It is therefore advantageous to seal the cavity of the hollow pistons. The usual procedure until now has been to close the hollow pistons with a cover connected to the main body of the piston by spin welding, electron-beam welding or laser welding. Hollow pistons of this kind are known, e.g. from DE-OS 23 64 725. Hollow pistons produced by means of electron-beam or laser welding are found in, e.g. DE 36 02 651 A1 and U.S. Pat. No. 3,319,575.

A feature common to these known hollow pistons is the necessity of prefabricating the main body and the cover in a complex machining process before the cover is welded to the main body. It is then necessary to rework the outer contour of the piston in a further machining step and make the central bore for supplying the pressure fluid to the pressure pockets of the sliding blocks connected to the ball heads. The overall result where the known hollow pistons are concerned is therefore a relatively complex and cost-intensive manufacturing process. A relatively large material inventory is also required.

The starting point of the invention is therefore a piston according to the preamble of claim 1 produced from a tubular blank and known from DE 34 06 782 C2. The process for producing these pistons is relatively inexpensive, as, instead of machining steps being required, the piston is obtained particularly easily by rolling from a tubular blank. However it has not until now been possible to produce hollow pistons with a cavity which is sealed towards the working cylinder of the hydrostatic machine by means of this known process.

It remains to be pointed out that it is known from DE 37 32 20 648 C2 to insert a tubular sleeve in a hollow piston produced by means of a machining manufacturing process and open towards the working cylinder of the axial piston machine and to fill the cavity between the sleeve and the hollow piston by means of a light material. However the inner tube does not in this case extend into the region of the ball head, and the ball head is formed by a solid body produced in a complex machining process rather than by a shaped outer tube.

The object of the invention is to provide a hollow piston for a hydrostatic machine having at least one sealed cavity which is of a particularly simple type, and to indicate a process for producing a hollow piston of this kind which can be carried out with cost-saving process steps and a low material requirement.

The object is achieved with respect to the piston according to the invention by an inner tube which extends inside the outer tube over the entire length of the latter, and which is fixed with a sealing effect to the outer tube at the common end on the skit part side, and wherein the outside diameter of the inner tube and the inside diameter of the outer tube are dimensioned so as to form a cavity between the inner tube and the outer tube, at least in the region of the skirt part. These characterizing features are considered in conjunction with the features constituting the type and with regard to the production process by introducing a blank for the inner tube into a blank for the outer tube, and shaping the blank of the outer tube to form the skirt part, the ball joint part and the neck part, so that the outer tube lies against the inner tube at the common end on the ball joint part side and the common end on the skirt part side.

The invention is based on the recognition that the known shaping process for forming a piston from a tubular blank for producing a hollow piston can be developed by using a second tubular blank which is inserted before shaping as an inner tube in the first blank functioning as an outer tube. The outer tube is then shaped until it lies against the inner tube, at least in the end regions. Further shaping produces in the inner tube a trough or a shoulder which axially fixes the inner tube to the outer tube. The result is a piston with a cavity which is formed between the inner tube and the outer tube and sealed towards the outside. The piston can be produced in a rotary swaging process without any machining manufacturing step. This production process is particularly cost-saving, especially in the series manufacture of large batches. A further result - in contrast with a machining manufacturing process - is the particularly good utilisation of material, which is especially important in particular when using relatively expensive alloys. The use of the tubular inner blank obviates the necessity of providing a central bore to feed the pressure fluid to the sliding blocks. Another advantage lies in the possibility of using a relatively inexpensive material for the inner tube, as it is subjected to smaller loads than the outer tube. This enables further manufacturing costs to be saved.

A further cavity may also be formed to particular advantage between the inner tube and the outer tube in the region of the ball joint part. The weight of the piston according to the invention is further reduced by this measure. The outer tube can lie flush against the inner tube in the region of the neck part connecting the ball joint part to the skirt part. The inner tube then defines the shaped diameter of the neck part when the outer tube is shaped.

The inner tube may comprise at the end on the ball head side and/or at the end on the skirt side, but also in the region of the neck part, a trough and/or a shoulder which is/are formed when the outer tube and the inner tube are shaped, so that the outer tube lies closely against the inner tube in this region. The inner tube is thus axially fixed in the outer tube.

The opening cross section of the inner tube may be constricted in the region of the trough and/or the shoulder to an extent such that a flow throttle is produced. The opening cross section of the flow throttle can be set by the shaping of the inner tube.

The outer tube may be shaped such that it also lies against the inner tube in the region of the neck part. This further improves the strength and flexural rigidity of the piston according to the invention.

The inner tube is shaped, this may advantageously be shaped to an extent such that a flow throttle with a predeterminable opening cross section is formed in the region of the trough and/or shoulder used for axial fixing purposes. The opening cross section of the flow throttle can be determined by introducing a fixing body into the inner tube before the latter is shaped, this body being removed again after the inner tube has been shaped.

Figure 1B:
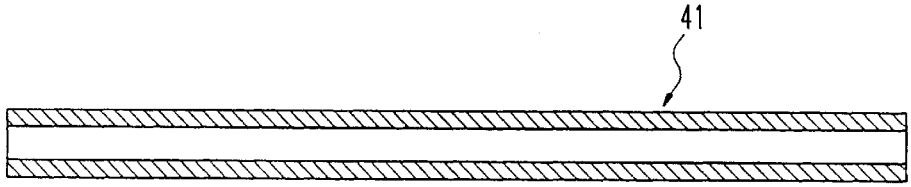
Figure 1C:
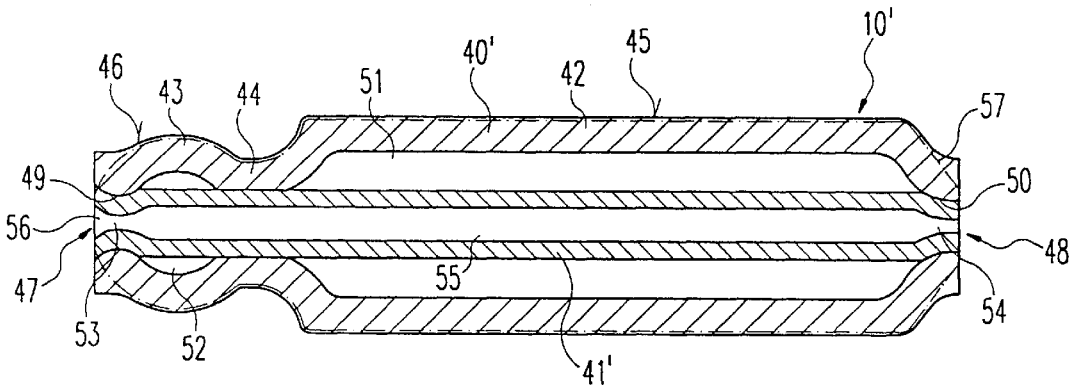
Figure 1D:
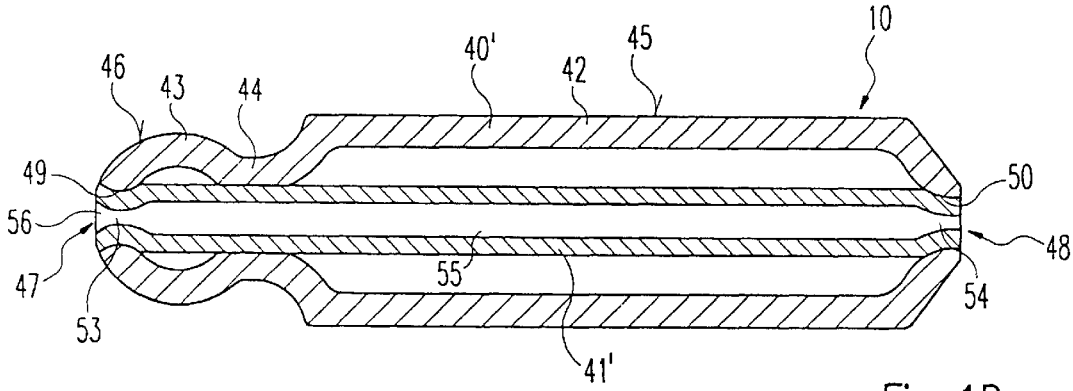
Figure 2:
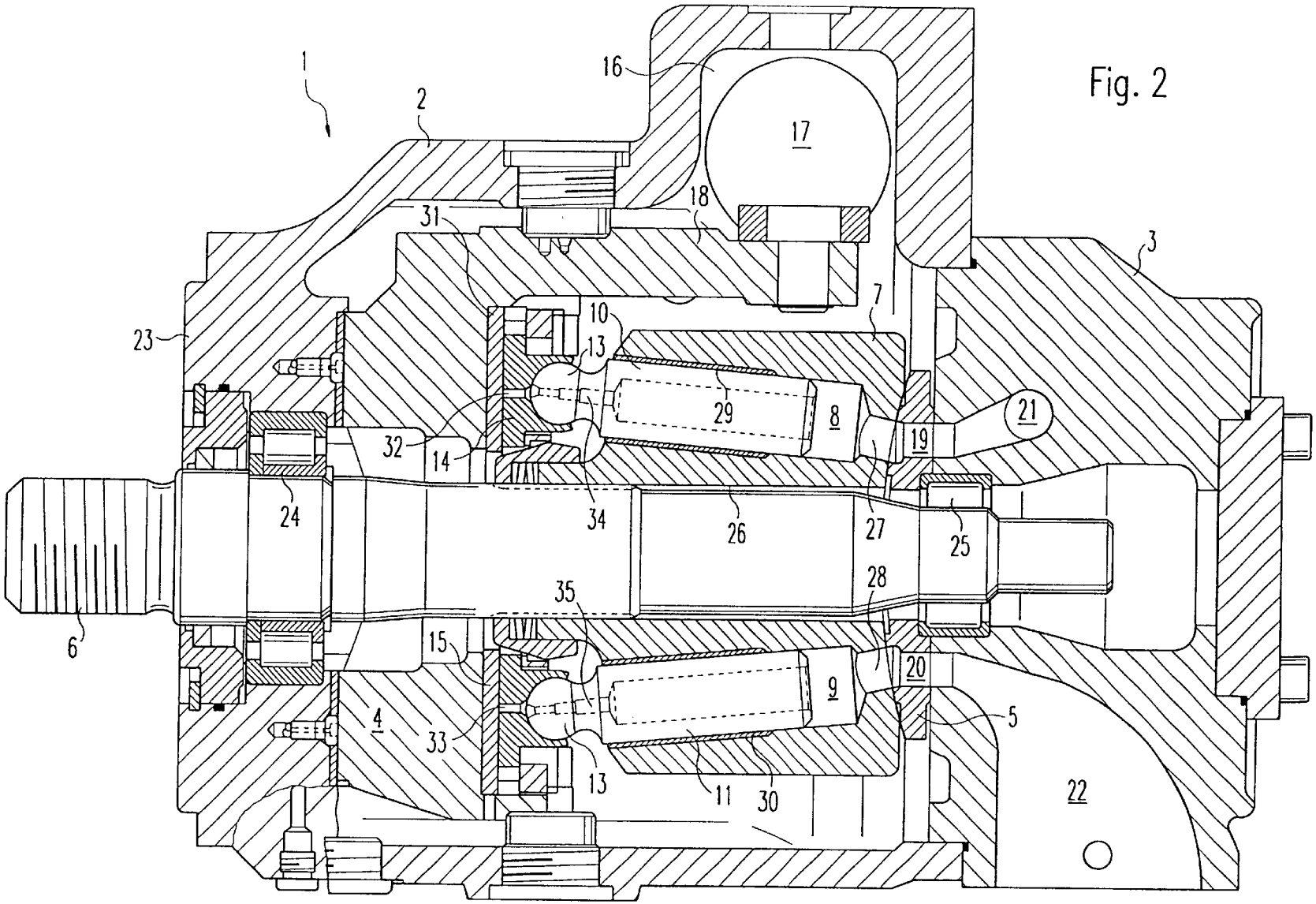

The invention is illustrated in detail in the following on the basis of a preferred embodiment. In the drawings:

FIG. 1A is an axial longitudinal section through the blank of the outer tube for producing the piston according to the invention, FIG. 1B is an axial longitudinal section through the blank of the inner tube for producing the piston according to the invention, FIG. 1C is an axial longitudinal section through the piston according to the invention after shaping the outer and inner tube, FIG. 1D is an axial longitudinal section through the piston according to the invention in its finished state, and FIG. 2 is an axial longitudinal section through an axial piston machine in which the piston according to the invention can be used.

In order to make the invention more comprehensible, an axial piston machine employing the hollow pistons according to the invention is firstly described on the basis of FIG. 2. However the invention is not limited to axial piston machines. On the contrary, the hollow pistons according to the invention can be used in various piston machines. The axial piston machine 1 represented in FIG. 2 is fitted with conventional hollow pistons rather than hollow pistons according to the invention.

The axial piston machine 1 shown in FIG. 2 is of swash plate design with an adjustable displacement volume and, as is known, comprises as essential components a hollow cylindrical casing 2, a connection block 3, which is secured to the casing 1, a swash plate 4, a control body 5, a drive shaft 6 and a cylinder barrel 7, in which the cylinder bores 8, 9 are disposed in a radially evenly distributed manner. The hollow pistons 10, 11 are disposed in a displaceable manner in the cylinder bores 8, 9, and the ball joint parts, which are formed as ball heads 12, 13 in the embodiment, of the hollow pistons 10, 11 are supported at the swash plate 4 via sliding blocks 14, 15.

An actuating device 17, which is accommodated in a convexity 16 of the casing 2, acts via an arm 18, which extends in the direction of the connection block 3, on the swash plate 4 and serves to pivot the latter about a pivot axis which is perpendicular to the pivot direction.

The control body 5 is secured to the inner surface, which faces the casing interior, of the connection block 3 and is provided with two through-openings in the form of kidney-shaped control slots 19, 20, which communicate via a pressure port 21 and an intake port 22, respectively, in the connection block 3 with a pressure and a suction line, respectively, which are not shown. The spherical control surface, which faces the casing interior, of the control body 5 serves as a bearing surface for the cylinder barrel 7.

The drive shaft 6 projects through a through-bore in the casing end wall 23 into the casing 2 and is rotatably mounted in this through-bore by means of a bearing 24 and in the connection block 3 by means of another bearing 25. The cylinder barrel 7 is connected in a torsion-proof manner to the drive shaft 6 by means of a keyway connection 26.

The cylinder bores are provided with outlet ports 27, 28, which open out on the same pitch circle as the control slots 19, 20 of the control body 5. A respective liner 29, 30 is inserted in the cylinder bores 8, 9. Each sliding block 14, 15 is provided at its slide surface which faces the slide plate 31 of the swash plate 4 with a respective pressure pocket, which is not shown, communicating via a respective through-bore 32, 33 in the sliding block 14, 15 with a stepped, axial through-port 34, 35 in the associated piston 10, 11 and thus being connected to the cylinder working space, which is delimited by the piston 10, 11 in the cylinder bore 8, 9.

DE 44 23 023 A1 is to be referred to for a detailed description of an axial piston machine of this design. The present invention relates to a development of the hollow pistons 10, 11.

FIGS. 1A and 1B show the two tubular blanks 40 and 41 for the hollow piston 10' and 10, respectively, according to the invention, which is shown in an intermediate state in FIG. 1C and in its finished state in FIG. 1D. FIGS. 1A and 1B are both axial sections through the blanks 40 and 41, while FIGS. 1C and 1D are axial sections through the entire hollow piston 10 according to the invention. The hollow cylindrical blank 40 with uniform wall thickness represented in FIG. 1A forms the outer tube 40' of the hollow piston 10 according to the invention, while the hollow cylindrical blank 41, which is likewise of uniform wall thickness, forms the inner tube 41' of the hollow piston 10 according to the invention.

In order to produce the intermediate part represented in FIG. 1C, the blank 41 of the inner tube 41' is introduced into the blank 40 of the outer tube 40', after which the blank 40 of the outer tube 40' is shaped so as to form the skirt part 42, the ball joint part 43 and the neck part 44 connecting the ball joint part 43 to the skirt part 42, as represented in FIG. 1C. This preferably takes place by rolling or rotary swaging the blank 41 in a die which predetermines the outer contour of the hollow piston in the intermediate state represented in FIG. 1C. The blanks 40 and 41 are preferably shaped in the cold state. After the blank 40 forming the outer tube 40' has been shaped, the skirt part 42 comprises a cylindrical surface 45 which provides the bearing surface of the piston 10 according to the invention. The spherical surface 46 for the ball joint part 43 is also formed. The ball joint part 43 is preferably a ball head according to the embodiment which is represented in FIGS. 1C and 1D and which co-operates with a spherical recess formed in the sliding blocks 14, 15.

However it is conversely also possible for the ball joint part 43 of the hollow pistons 10 to be formed as a spherical recess and co-operate with a corresponding ball head of the associated sliding block 14 or 15.

When the blank 40 forming the outer tube 40' is shaped, this blank is initially shaped to an extent such that the outer tube 40' is brought to bear against the inner tube 41' at the end 47 on the ball joint part side and at the end 48 on the skirt side. The outer tube 40' is, moreover, preferably shaped in the region of the neck part 44 to an extent such that the outer tube 40' lies flush against the inner tube 41' at this point. The diameter of the neck part 44 is then predetermined by the outside diameter of the 30 inner tube 41' and the wall thickness of the outer tube 40'. The outer tube 40' is then shaped even further in the end region 47 on the ball joint side and the end region 48 on the skirt part side with a shaping force which is directed radially inwards, so that the inner tube 41' is pushed inwards. In the illustrated embodiment this results in a trough 49 in the inner tube 41' at the end 47 on the ball joint part side and a shoulder 50 on the inner tube 41' at the end 48 on the skirt part side. The outer tube 40' and the inner tube 41' are plastically deformed in this region such that the outer tube 40' lies closely against the inner tube 41' in the region of the trough 49 and the shoulder 50. The inner tube 41' is thus fixed to the outer tube 40'. It is in addition also possible to shape the inner tube 41' in the region of the neck part 44 like a trough, thus creating an additional axial fixing mechanism between the inner tube 41' and the outer tube 40' in the region of the neck part.

The outside diameter of the inner tube 41' and the inside diameter of the outer tube 40' are in this case adapted to one another so as to create an annular cavity 51, at least in the region of the skirt part 42. Another annular cavity 52 is preferably also created between the inner tube 41' and the outer tube 40' in the region of the ball joint part 43, as also represented in the embodiment of FIGS. 1C and 1D. The two cavities 51 and 52 are sealed hermetically and preferably so as to be liquid-tight towards the outside by squeezing the outer tube 40' and the inner tube 41' together at the end region 47 on the ball joint part side and the end region 48 on the skirt part side, so as to prevent pressure fluid from entering these tubes 41 and 42. If required, the inner tube 41' and the outer tube 40' can additionally be welded together.

The cavities 51 and 52 greatly reduce the weight of the hollow piston 10 according to the invention with respect to conventional pistons of solid design, so that the centrifugal forces and inertial forces exerted by the pistons 10 are greatly reduced. A further weight reduction can be achieved by using material with a low relative density, e.g. aluminium, for the inner tube 41'. This is possible because the inner tube 41' is subjected to a substantially smaller mechanical load than the outer tube 40'. It is on the other hand also possible to use an inexpensive material of an inferior quality for the inner tube 41', so that the manufacturing costs for the hollow pistons 10 according to the invention are further reduced.

The trough 49 formed at the inner tube 41' and the shoulder 50 advantageously act as a flow throttle at the same time, so that the pressure fluid flowing towards the pressure pockets of the sliding blocks 14, 15 via the interior 55 of the inner tube 41' is throttled. The desired opening cross section of the flow throttles 53 and 54 can be set by the shaping of the inner tube 41' in the region of the trough 49 and the shoulder 50. The opening cross section of the flow throttles 53 and 54 can be varied either by using different dies or through different radial contact forces. A fixing body, which is not shown, of, e.g. hollow cylindrical or cylindrical shape, may advantageously be introduced into the inner tube 41' in the region of the trough 49 and/or the shoulder 50, which body defines the remaining opening cross section when the inner tube 41' is shaped. The fixing body can be removed after the inner tube 41' has been shaped.

The trough 49 also produces the trumpet-shaped opening 56, which is also desired, at the mouth of the interior 55 of the inner tube 41' which is on the ball joint part side. This trumpet-shaped opening 56 cooperates with a corresponding trumpet-shaped opening in the associated sliding block 14, 15, so that the pressure fluid connection between the hollow piston 10 and the sliding blocks 14, 15 is guaranteed in each angular position of the hollow pistons 10.

FIG. 1D shows the hollow piston 10 according to the invention in its finished state. The hollow piston 10 according to the invention has been reworked along the dot-dash contour line 57 in FIG. 1C, preferably in a machining step, in order to obtain the hollow piston 10 according to the invention with the desired final contour. However this finishing step may be dispensed with or just restricted to machining the bearing surfaces 45, e.g. by grinding, depending on the desired outer contour of the hollow piston 10 according to the invention.

The development according to the invention results in a hollow piston 10 which is of a low weight and which can be produced at an extremely low cost.

What is claimed is:

1. Piston for a hydrostatic machine with an outer tube, which is formed into a skirt part and a ball joint part which are connected via a neck part, characterised by an inner tube, which extends inside the outer tube over the entire length of the latter and which is fixed with a sealing effect to the outer tube at the common end on the skirt part side, wherein the outside diameter of the inner tube and the inside diameter of the outer tube are dimensioned so as to form a cavity between the inner tube and the outer tube, at least in the region of the skirt part.

2. Piston according to claim 1, characterised in that another cavity is formed between the inner tube and the outer tube in the region of the ball joint part.

3. Piston according to claim 1, characterised in that the outer tube lies against the inner tube in the region of the neck part.

4. Piston according to claim 1, characterised in that a trough is formed at the end on the ball joint part side, in or against which trough the outer tube lies closely to axially fix the inner tube.

5. Piston according to claim 4, characterised in that the opening cross section of the inner tube is constricted in the region of the trough to an extent such hat a flow throttle is formed which throttles the flow of a pressure fluid through the inner tube.

6. Piston according to claim 1, charactrised in that a trough is formed in a region o the neck part, in or against which trough the outer tube lies closely to axially fix the inner tube.

7. Piston according to claim 1, characterised in that a shoulder is formed at the end on the skirt part side, in or against which shoulder the outer tube lies closely to axially fix the inner tube.

8. Piston according to claim 7, characterised in that the opening cross section of the inner tube is constricted in the region of the shoulder to an extent such that a flow throttle is formed which throttles the flow of a pressure fluid through the inner tube.

9. Piston according to claim 1, characterised in that a shoulder is formed in a region of the neck part, in or against which shoulder the outer tube lies closely to axially fix the inner tube.

10. Piston according to claim 1, characterized in that the outer tube is constructed of a stronger material than the inner tube.

11. Process for producing a piston according to claim 1, with the following process steps:

introducing a blank for the inner tube into a blank for the outer tube, and shaping the blank of the outer tube to form the skirt part, the ball joint part and the neck part, so that the outer tribe lies against the inner tube at the common end on the ball joint part side and the common end on the skirt part side.

12. Process according to 11, characterised by further shaping of the outer tube together with the inner tube until a trough is formed at the inner tube, in which trough the inner tube is fixed to the outer tube.

13. Process according to claim 12, characterised in that the outer tube is shaped such that it also lies against the inner tube in a region of the neck part.

14. Process according to claim 12, characterised in that the inner tube is shaped until a flow throttle with a predeterminable opening cross section is formed in the region of the trough.

15. Process according to claim 14, characterised in that a fixing body, which is in particular characterised in that a fixing body, which is in particular of hollow cylindrical or cylindrical shape, is introduced into the inner tube before the latter is shaped, which body determines the opening cross section of the flow throttle and is removed from the inner tube after the latter has been shaped.

16. Process according to 11, characterised by further shaping of the outer tube together with the inner tube until a shoulder is formed at the inner tube, in which shoulder the inner tube is fixed to the outer tube.

17. Process according to claim 16, characterised in that the outer tube is shaped such that it also lies against the inner tube in a region of the neck part.

18. Process according to claim 16, characterised in that the inner tube is shaped until flow throttle with a predeterminable opening cross section is formed in the region of the shoulder.

19. Process according to claim 18, characterised in that a fixing body, which is in particular of hollow cylindrical or cylindrical shape, is introduced into the inner tube before the latter is shaped, which body determines the opening cross section of the flow throttle and is removed form the inner tube after the latter has been shaped.

20. Process according to claim 11, characterised in that the outer contour of the piston is reworked by a machining process.

* * * * *